United States Patent [19]

Golias

[11] Patent Number: 4,811,866

[45] Date of Patent: Mar. 14, 1989

[54] METHOD AND APPARATUS FOR DISPENSING LIQUIDS

[75] Inventor: Tipton Golias, Beaumont, Tex.

[73] Assignee: Helena Laboratories Corporation, Beaumont, Tex.

[21] Appl. No.: 266

[22] Filed: Jan. 2, 1987

[51] Int. Cl.[4] ..... B67D 5/58

[52] U.S. Cl. ..... 222/189; 222/215; 222/420

[58] Field of Search ..... 222/187, 206, 215, 214, 222/209, 420; 604/414

[56] References Cited

U.S. PATENT DOCUMENTS

| | | | |
|---|---|---|---|
| 2,348,831 | 5/1944 | Mathis | 222/189 |
| 2,936,099 | 5/1960 | Smith | 222/189 |
| 3,098,589 | 7/1963 | Graham | 222/189 |
| 3,481,477 | 12/1969 | Farr | 210/389 |
| 3,512,940 | 5/1970 | Shapiro | 23/299 |
| 3,654,925 | 4/1972 | Holderith | 23/230 |
| 3,693,804 | 9/1972 | Grover | 128/272 |
| 3,750,645 | 8/1973 | Bennett et al. | 128/2 G |
| 3,779,383 | 12/1973 | Ayres | 210/84 |
| 3,807,955 | 4/1974 | Note, Jr. | 23/230 B |
| 3,814,258 | 6/1974 | Ayres | 210/359 |
| 3,849,072 | 11/1974 | Ayres | 23/259 |
| 3,850,174 | 11/1974 | Ayres | 128/272 |
| 3,862,042 | 1/1975 | Ayres | 210/516 |
| 3,882,021 | 5/1975 | Ayres | 210/136 |
| 3,887,464 | 6/1975 | Ayres | 210/117 |
| 3,887,465 | 6/1975 | Ayres | 210/130 |
| 3,887,466 | 6/1975 | Ayres | 210/131 |
| 3,890,237 | 6/1975 | Welch | 210/516 |
| 3,891,553 | 6/1975 | Ayres | 210/136 |
| 3,894,950 | 7/1975 | Ayres et al. | 210/131 |
| 3,894,951 | 7/1975 | Ayres | 210/136 |
| 3,894,952 | 7/1975 | Ayres | 210/136 |
| 3,897,337 | 7/1975 | Ayres | 210/136 |
| 3,897,340 | 7/1975 | Ayres | 210/314 |
| 3,897,343 | 7/1975 | Ayres | 210/516 |
| 3,901,402 | 8/1975 | Ayres | 215/248 |
| 3,919,085 | 11/1975 | Ayres | 128/272 |
| 3,920,549 | 11/1975 | Gigliello | 210/109 |
| 3,920,557 | 11/1975 | Ayres | 210/516 |
| 3,931,010 | 1/1976 | Ayres et al. | 210/109 |
| 3,935,113 | 1/1976 | Ayres | 210/516 |
| 3,941,699 | 3/1976 | Ayres | 210/117 |
| 3,945,928 | 3/1976 | Ayres | 210/516 |
| 3,951,801 | 4/1976 | Ayres | 210/516 |
| 3,957,654 | 5/1976 | Ayres | 210/117 |
| 3,972,812 | 8/1976 | Gresl, Jr. | 210/77 |
| 3,986,962 | 10/1976 | Kessler | 210/516 |
| 4,118,195 | 10/1978 | Beach | 222/215 |
| 4,243,534 | 1/1981 | Bulbenko | 210/656 |
| 4,257,886 | 3/1981 | Kessler | 210/516 |
| 4,300,404 | 11/1981 | Mehl et al. | 73/863.52 |
| 4,350,593 | 9/1982 | Kessler | 210/83 |
| 4,417,981 | 11/1983 | Nugent | 210/209 |

FOREIGN PATENT DOCUMENTS

| | | | |
|---|---|---|---|
| 812289 | 7/1949 | Fed. Rep. of Germany | 222/189 |
| 1063755 | 8/1959 | Fed. Rep. of Germany | 222/420 |
| 1333865 | 7/1963 | France | 222/420 |
| 521237 | 6/1938 | United Kingdom | 222/420 |
| 659217 | 5/1949 | United Kingdom | 222/420 |

*Primary Examiner*—Joseph J. Rolla
*Assistant Examiner*—Kenneth Noland
*Attorney, Agent, or Firm*—Spencer & Frank

[57] ABSTRACT

An apparatus for dispensing a liquid is provided which is adapted to be attached to a container such as a test tube and includes a hollow resilient dispensing member having a nipple at one end through which a liquid is dispensed in a dropwise manner. The dispensing member is formed of a resilient material which enables liquid to be dispensed therethrough by squeezing the sides of the dispensing member. In a modification, the dispensing member is provided with an internal filter by which fluid can be conveniently filtered as it is dispensed. A method for dispensing a liquid from a container using the apparatus of the present invention is also provided.

9 Claims, 1 Drawing Sheet

METHOD AND APPARATUS FOR DISPENSING LIQUIDS

TECHNICAL FIELD

The present invention relates generally to dispensing methods and apparatus and more specifically to methods and apparatus for separating, filtering and dispensing liquids such as blood serum, saline-washed red blood cells, and other biological fluids.

BACKGROUND OF THE INVENTION

The separation and analysis of chemical substances provides valuable quantitative and qualitative data for use by researchers and health care providers. Many assaying techniques have been deviced which utilize sensitive chemical and instrument tests to detect both normal and abnormal components of biological fluids. In particular, the analysis of blood samples yields information which is critical to the proper diagnosis and treatment of many illnesses. To perform a blood test, a sample is obtained and then prepared for analysis by one of the many analytical procedures currently available. The preparation of the sample typically requires that the various sample components be separated in order to obtain a more nearly homogeneous specimen for testing, such as isolating blood serum which is then dispensed for analysis. The amount of serum protein, proteinbound iodine, sodium, triglycerides, salicylate, uric acid and the like can all be determined through the separation and analysis of blood components. Hence, fast and accurate methods for preparing and dispensing samples for analysis are highly desirable.

The task of conveniently and efficiently dispensing a liquid, such as a biological fluid, from a container such as a test tube is encountered routinely by lab workers in a variety of circumstances. The mouth of a test tube must be large enough for material to be readily added to the tube chamber; however, this feature makes it difficult to dispense fluid from the test tube. Conventional dispensing techniques are only marginally effective in many applications. For example, decanting a liquid from a precipitate using a stirring rod requires considerable manipulative skill and fails to provide adequate control over the volume of liquid to be dispensed. Similarly, while providing a lip or spout on a container may help direct the flow of fluid somewhat, volume control is still not attained and splashing often occurs. The transfer of liquids is more accurately controlled with a dropper pipet; however, this requires that a pipet be provided and that the pipetting operation be preformed each time a liquid sample is dispensed.

Particularly in the environment of processing and dispensing biological fluids, a simple and convenient method and apparatus are needed so that a fluid can be easily dispensed from a container such as a test tube. The present invention provides such a method and apparatus whereby virtually any liquid can be easily dispensed without the use of complicated pouring techniques and devices.

SUMMARY OF THE INVENTION

In accordance with the present invention there is provided an elongate, hollow, resilient dispensing device adapted to be engaged on the open end of a test tube or other similar container. The hollow dispensing device includes a resilient tube having a broad opening at one end and a nipple at the other end. A filter may also be provided within the resilient tube such that fluid passing through the dispensing device passes through the filter. In the metod of the present invention, the resilient dispensing tube is attached to the mouth of a container such as a test tube containing a liquid sample so that the dispensing tube is frictionally engaged by the container wall in a concentric manner to form a seal. The nipple end extends out beyond the open end of the container as does a substantial portion of the resilient dispensing tube. The container and attached sampling tube are then inverted so that the liquid to be dispensed flows into the resilient sampling tube. If a filter is provided, the liquid flows through the filter to remove any unwanted components such as gel. By squeezing the sides of the resilient sampling tube, one or more drops of fluid can be accurately dispensed through the nipple. A cup is also provided which prevents evaporation or leakage of the sample through the nipple opening.

The present invention further provides both a method by which a stratified layer of filtrate can be isolated and conveniently dispensed from a sampling apparatus, and a sampling apparatus which can be used to separate and dispense a filtrate at a controlled rate. Hence, the present invention is adapted to be attached to a conventional sampling container apparatus for dispensing a precise quantity of liquid at a controlled rate.

DESCRIPTION OF THE PREFERRED EMBODIMENTS

Figure 1:
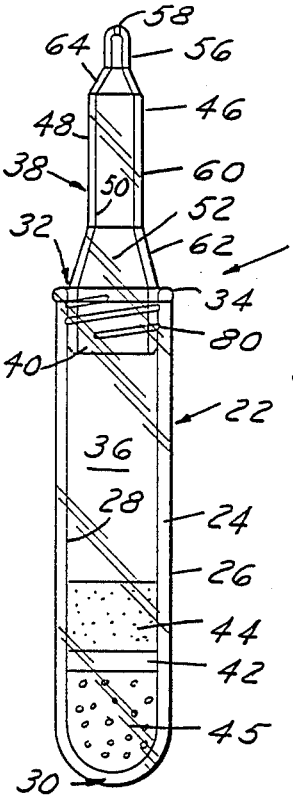
FIG. 1 is a side-elevational view of the present invention with a partially threaded resilient dispensing member closely fitted within the mouth of a test tube.

Referring now to FIG. 1 of the drawings, dispenser assembly 20 includes tube 22 with wall 24 having outer wall surface 26 and inner wall surface 28. Closed end 30 of tube 22 is shown rounded or hemi-spherical. At the end of tube 22 opposite closed end 30 is mouth 32 which is provided with an annular rim 34. Inner wall surface 28 defines a chamber 36. Closed end 30 may be provided with a stopcock or valve if desired.

It should be recognized that tube 22 may comprise a standard test tube or the like. Frictionally held within mouth 32 of tube 22, is resilient dispensing member 38 which, in this embodiment, is shown as having threaded stem 40 which forms a seal with inner wall surface 28 of tube 22 at mouth 32. This frictional seal holds resilient dispensing member 38 securely in place during use. Although tube 22 and resilient dispensing member 38 are shown having generally circular cross-sections, other shapes may be suitable such as ovals, rectangles or the like. In this embodiment, gel 42 is shown separating a liquid specimen such as a blood sample into discrete layers including a serum light layer 44 and a heavy layer 45, with serum light layer 44 to be dispensed through resilient dispensing member 38. Suitable gels for achieving this manner of separation are of the kind which allow the selective passage of a component of a liquid system through gel 42 during centrifugation or by the downward gravitational movement of gel 42 in tube 22 which will be known to those skilled in the art. One suitable separator gel for use herein is sold by the Terumo Medical Company of Elkton, Maryland, under the trademark AUTOSEP. Other means for attaining this segregation of layers may be appropriate for use herewith, such as the porous disc (not shown) disclosed in Gresl, U.S. Pat. No. 3,972,812. It is to be understood that the present invention may be used to dispense any liquid, including biological fluids, and that these fluids may not necessarily be stratified as layers or filtered. However, the present invention in one aspect comprehends both filtering and dispensing biological fluids.

Figure 6:
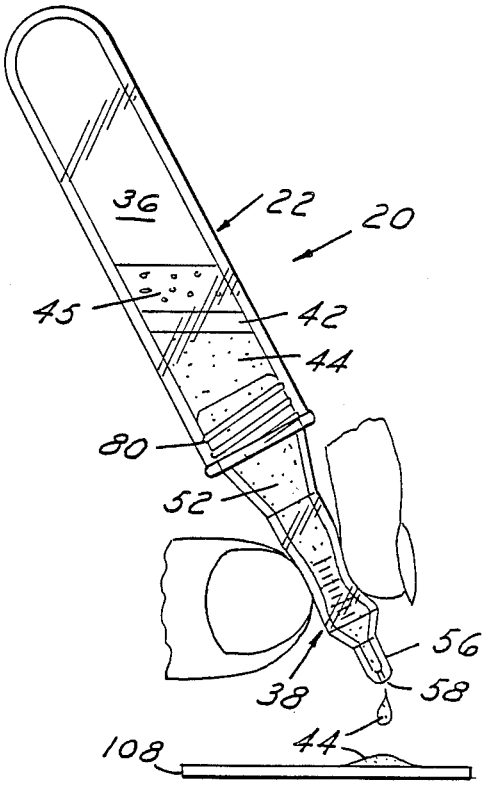
FIG. 6 is a side elevational view of the device illustrated in FIG. 1 with the sides of the resilient dispensing member being compressed to dispense drops of filtrate onto a glass slide.

Resilient dispensing member 38 includes wall 46 having outer wall surface 48 and inner wall surface 50, the latter defining dispensing chamber 52. Dispensing chamber 52 extends through resilient dispensing member 38 from dispensing member opening 54 to nipple 56. Nipple 56 is provided at its end with a narrow passage 58, through which, as will be shown, liquid is conveniently dispensed in drop-like fashion. Body 60 of resilient dispensing member 38 is interposed between a first constricted portion 62 and a second constricted portion 64 of resilient dispensing member 38. The length of each portion of resilient dispensing member 38 can vary somewhat in accordance with the requirements of a particular use, however, body 60 should be of sufficient length to allow a user to grasp and squeeze it as shown in FIG. 6 of the drawings.

In a modification of the present invention, there is seen securely held with dispensing chamber 52 of resilient dispensing member 38 filter plug 66. Filter plug 66, as will be explained more fully, serves to prevent gel 42 or other unwanted particulate matter from being dispensed when the liquid is dispensed. In this embodiment filter plug 66 is frictionally held in place by inner wall surface 50 of resilient dispensing member 38. It may be desirable in some applications to secure filter plug 66 in place with an adhesive or the like. Filter plug 66 must provide good sealing engagement with inner wall surface 50 so that only serum light layer 44 passes through filter plug 66 to thus remove the unwanted particulate matter.

Figure 2:
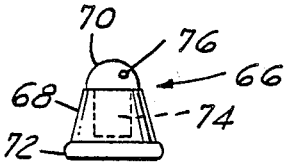
FIG. 2 is a side-elevational view of a filter-containing plug for use in the present invention.

A suitable filter plug 66 for use herein is shown in FIG. 2. Filter plug 66 includes tapered body section 68 which is circular in cross-section. Dome 70 is attached to tapered body section 68 at the smaller end of the body section 68. Flange 72 is connected to and extends radially from the large end of tapered body section 68 and is angled slightly away from filter plug 66. It is preferred that tapered body section 68, dome 70 and flange 72 be formed as a unitary body which comprises filter plug 66. Filter plug 66 is somewhat resilient and can be formed of flexible materials such as rubber or soft plastic. A bore (not shown) is provided inside filter plug 66 to closely receive filter member 74 (shown in phantom) therein. It may be desirable to provide filter 74 with one hemispherical end (not shown) which is received within, but is spaced slightly apart from, the interior surface of dome 70. It should be pointed out that the filter receiving bore extends from an opening (not shown) at the large end of filter plug 66 through tapered body section 68 and into dome 70. At least one perforation 76 is also provided in dome 70 to provide a path for serum light layer 44 to exit filter plug 66. Alternatively, dome 70 may be omitted in some applications. Also, filter plug 66 may comprise a simple one-way valve or the like.

Figure 3:
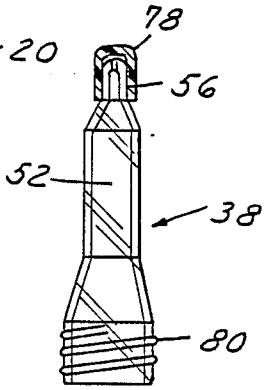
FIG. 3 is a side-elevational view of the device illustrated in FIG. 1 with a cap shown in cross-section.
Figure 4:
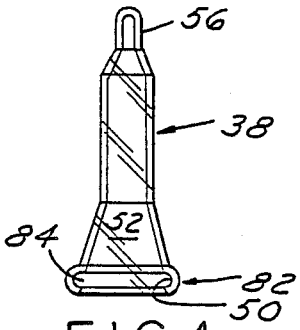
FIG. 4 is a side-elevational view of the present invention in an arrangement adapted to be fitted over the rim of a test tube.

In FIG. 3, cap 78 is shown covering nipple 56 to prevent evaporation or leakage of liquid through passage 58. Cap 78 can be provided with an exterior rim and interior groove to enhance the cap seal and facilitate engagement and removal of cap 78. It should also be pointed out that threads 80 facilitate the insertion of resilient dispensing member 38 into mouth 32 of tube 22 and provide a seal with inner wall surface 28 so that during dispensation, liquid moves from chamber 36 into dispensing chamber 52 without leaking between inner wall surface 28 of tube 22 and outer wall surface 48 of resilient dispensing member 38 at threads 80. Alternatively, threads 80 could be omitted provided that the outer wall surface 48 forms a strong frictional seal with inner wall surface 28 to prevent leakage and secure resilient dispensing member 38 in place during operation of dispenser assembly 20. It may be desirable in some instances to use an adhesive or the like to make this connection. In FIG. 4, stem 82 comprises a flexible annular rim 84 which can be fitted over mouth 32 to provide the necessary connection of dispensing chamber 52 with chamber 36. In this configuration the cross-section of stem 82 at its inner wall surface 50 is slightly larger than that of annular rim 34 of tube 22. This permits stem 82 to grip annular rim 34, forming a tight, liquid-impervious seal. Stem 82 may also be provided with an internal annular groove (not shown) for receiving annular rim 34 in a frictional interlocking manner.

Figure 5:
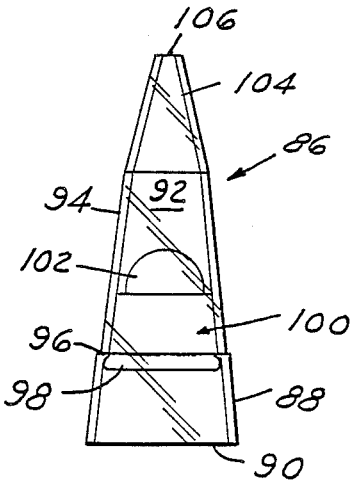
FIG. 5 is a side elevational view of another arrangement of the present invention with the plug illustrated in FIG. 4 inserted therein.

In another embodiment of the present invention, as shown in FIG. 5, resilient dispensing member 86 includes tapered stem section 88 having opening 90 which closely receives tube 22 such that chamber 36 and dispensing chamber 92 form a continuous passage when connected in any manner previously described. An intermediate tapered section 94 is provided, the large end of which is joined to the small end of tapered stem section 88. At the junction of tapered stem section 88 and intermediate tapered section 94, annular ledge or shoulder 96 is optionally provided which acts as a seat for flange 98 of filter plug 100. As seen best in FIG. 5, in a modification of the present invention filter plu,g 100 is inserted in tapered stem section 88 through opening 90, dome 102 first, and forced downwardly until flange 98 rests on shoulder 96 which as stated acts as a seat or stop for filter plug 100. Hence further movement of filter plug 100 into intermediate tapered section 94 is prevented. Attached to intermediate tapered section 94 at its narrow end is nipple 104 having passage 106. Nipple 104 is also a tapered section. Tapered stem section 88, intermediate tapered section 94 and nipple 104 form dispensing chamber 92, the cross-section of which decreases in the direction of passage 106. It will be understood that the tapering feature of tapered stem section 88 allows tube 22 to be snugly received therein, providing a substantially liquid-tight seal. Again, resilient dispensing member 86 is made of a flexible, resilient material which also facilitates the insertion of tube 22 in opening 90.

In the method of the present invention, a liquid to be dispensed is placed in chamber 36 of tube 22. In the case of a biological fluid such as blood, a specimen may be segregated in tube 22 to form serum light layer 44 and a heavy layer 45, perhaps partitioned by gel 42. This can be achieved in the known manner by inserting gel 42 into chamber 36 with a specimen such as blood and centrifuging the specimen. As the gel 42 is forced downwardly by centrifugal force, the blood serum selectively flows through gel 42, to form serum light layer 44. When substantially all of the blood serum has passsed through gel 42, the downward movement of gel 42 ceases due to the presence of heavy layer 45 which does not pass through gel 42.

Once the light to be dispensed is ready in chamber 36, resilient dispensing member 38 is inserted into mouth 32 in any of the described manners. As shown best in FIG. 6, dispenser assembly 20 is then inverted whereby the liquid, such as serum light layer 44, flows into resilient dispensing member 38 and, in this embodiment in which a filter is provided, through filter plug 66 toward nipple 56. By simply squeezing resilient dispensing member 38 with one's fingers one or more drops of fluid is dispensed or "pumped" through passage 58 onto glass slide 108 or the like. Resilient dispensing member 38 can be formed of various materials which will provide the required resiliency or flexibility necessary to attain the pumping action which propels liquid through passage 58. Suitable materials include rubber and certain plastics such as ethylene vinyl acetate, styrene, polyethylene, and polypropylene. The thickness of wall 46 must of course be such that the requisite resiliency is achieved for pumping action. Filter plug 66, when included in the present invention, prevents gel 42, or other material desired to be filtered out of the liquid, from flowing out of dispensing chamber 52.

It should also be pointed out that the resilient dispensing member 38 could be attached to conventional test tubes to conveniently dispense any liquid and may or may not include filter plug 66. Such use is expressly contemplated as being within the scope of the present invention.

What is claimed is:

1. Apparatus for dispensing a liquid from a container having at least one opening, comprising:

a flexible elongated member having a longitudinal axis and having a bore therethrough, said flexible elongated member being adapted to be connected to said container at said one container opening;

said flexible elongated member connected to said container to form a substantially fluid-tight seal;

said flexible elongated member including a first tapering fluid constricting portion which receives a filter therein, and a second tapering fluid constricting portion, said first and second tapering fluid constructing portions being longitudinally spaced apart and interconnected by a body portion;

said apparatus having first and second outermost ends, said second outermost end extending transverse to the longitudinal axis and including an opening therein in communication with said bore; and whereby said flexible elongated member as connected to said container forms a continuous passage through which liquid flows from said container through the opening in said container and through the bore of the flexible elongated member, in response to external force applied upon said flexible elongated member in a generally inward direction.

2. The invention of claim 1 further comprising a filter positioned in said bore of said flexible elongated member.

3. The invention of claim 1 wherein said first outermost end includes a nipple having an opening therein, said nipple being disposed at said first outermost end of said flexible elongated member and communicating with said bore, said nipple having at least one open end; whereby said continuous passage through which said liquid flows includes said nipple and the nipple opening.

4. The invention of claim 3 further comprising a cap which fits snugly over said nipple and prevents evaporation and leakage of said liquid through said nipple opening.

5. The invention as defined in claim 3 wherein said nipple is integrally formed as part of said flexible elongated member.

6. The invention of claim 1 wherein said flexible elongated member has a centrally disposed longitudinal bore therethrough.

7. The invention as defined in claim 1 wherein said flexible elongated member is force fit into sealing engagement with said container.

8. The invention as defined in claim 1 wherein said flexible elongated member is force fit into sealing engagement on the outer surface of said container.

9. The invention as defined in claim 1 wherein said flexible elongated member is threaded into sealing engagement with said container.

* * * * *